US007322157B2

(12) United States Patent
Hang

(10) Patent No.: US 7,322,157 B2
(45) Date of Patent: Jan. 29, 2008

(54) CEILING PANELING SYSTEM

(75) Inventor: Wei Zhan Hang, Xiamen (CN)

(73) Assignee: Hunter Douglas Industries BV, El Rotterdam (NL)

( * ) Notice: Subject to any disclaimer, the term of this patent is extended or adjusted under 35 U.S.C. 154(b) by 355 days.

(21) Appl. No.: 10/630,948

(22) Filed: Jul. 29, 2003

(65) Prior Publication Data

US 2004/0055239 A1 Mar. 25, 2004

(30) Foreign Application Priority Data

Jul. 30, 2002 (EP) ..... 02078119

(51) Int. Cl.
*E04B 9/10* (2006.01)
*E04B 9/22* (2006.01)
*E04B 9/30* (2006.01)

(52) U.S. Cl. ..... 52/506.08; 52/506.07; 52/506.06; 52/545; 52/511; 248/322; 248/339; 248/343

(58) Field of Classification Search ..... 52/506.08, 52/509, 510, 506.09, 506.1, 511, 545, 506.06, 52/506.07; 248/322, 339, 343; 403/314, 403/218

See application file for complete search history.

(56) References Cited

U.S. PATENT DOCUMENTS 1,833,174 A * 11/1931 Norris ..... 52/731.7
2,073,036 A * 3/1937 Voigt ..... 52/506.1
2,662,743 A * 12/1953 Frenger ..... 165/56
2,662,745 A * 12/1953 Jorn et al. ..... 165/56
2,882,558 A * 4/1959 Jacobson et al. ..... 52/506.09
2,894,291 A * 7/1959 Sorenson ..... 52/779
2,963,751 A * 12/1960 Mancini ..... 52/506.09
3,163,961 A * 1/1965 Kemp ..... 52/144
3,241,282 A * 3/1966 Kemp ..... 52/506.1
3,246,074 A * 4/1966 Neumann et al. ..... 174/493
3,251,168 A * 5/1966 Waring et al. ..... 52/460
3,280,530 A * 10/1966 Rothenbach ..... 52/731.2
3,302,550 A * 2/1967 Thomson ..... 454/303
3,479,073 A * 11/1969 Collins ..... 52/506.1
3,581,453 A * 6/1971 Jones et al. ..... 52/506.1
3,733,995 A * 5/1973 Brown ..... 454/303
3,832,820 A * 9/1974 Eggert ..... 52/506.08
3,916,577 A * 11/1975 Vare ..... 52/506.1
4,175,360 A * 11/1979 Mulvey ..... 52/28
4,206,578 A * 6/1980 Mieyal ..... 52/733.1
4,520,609 A * 6/1985 Worley et al. ..... 52/733.1
4,561,233 A * 12/1985 Harter et al. ..... 52/506.1
4,640,064 A * 2/1987 Goodworth, II ..... 52/506.08
4,736,564 A * 4/1988 Gailey ..... 52/506.07

(Continued)

FOREIGN PATENT DOCUMENTS

CA 2 333 813 7/2002

(Continued)

*Primary Examiner*—Lanna Mai
*Assistant Examiner*—Phi Dieu Tran A
(74) *Attorney, Agent, or Firm*—Dorsey & Whitney LLP

(57) ABSTRACT

A paneling system for ceilings of a building structure in which the panels are suspended by hook shaped flanges, on opposite sides of each panel from flat arms of L- or Z-shaped panel carriers or support rails. One flange of each panel extends over the flange of a neighboring panel atop the horizontal arm of a panel carrier.

4 Claims, 3 Drawing Sheets

U.S. PATENT DOCUMENTS

| | | | | | |
|---|---|---|---|---|---|
| 4,760,677 | A | * | 8/1988 | Nassof | 52/506.1 |
| 4,833,858 | A | * | 5/1989 | Hutchison | 52/475.1 |
| 4,937,994 | A | * | 7/1990 | Ritter | 52/506.07 |
| 4,944,129 | A | * | 7/1990 | Hartleif | 52/506.08 |
| 4,986,050 | A | * | 1/1991 | Brunetti et al. | 52/506.08 |
| 5,076,036 | A | * | 12/1991 | Kuiper | 52/506.07 |
| 5,311,719 | A | * | 5/1994 | Jahn | 52/506.09 |
| 5,522,193 | A | * | 6/1996 | Sommerstein et al. | 52/235 |
| 5,598,678 | A | * | 2/1997 | Reynolds | 52/506.09 |
| 5,692,345 | A | * | 12/1997 | Mogaki et al. | 52/483.1 |
| 5,809,730 | A | * | 9/1998 | Renz | 52/506.09 |
| 6,648,752 | B2 | * | 11/2003 | Vernier et al. | 454/304 |

FOREIGN PATENT DOCUMENTS

| | | |
|---|---|---|
| DE | 1 934 185 | 1/1971 |
| DE | 19 34 185 | 1/1971 |
| DE | 84 375 92 U | 9/1985 |
| DE | 100 42 155 | 3/2002 |
| FR | 1 203 394 | 1/1960 |
| GB | 1 353 001 | 5/1974 |

* cited by examiner

Fig.4.1.

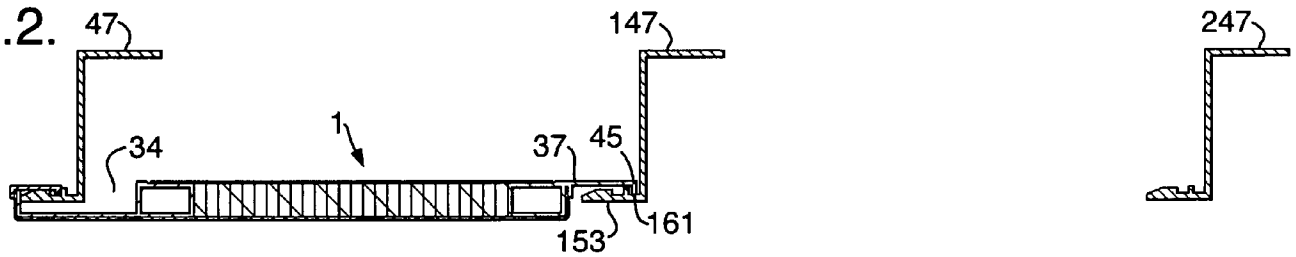
Fig.4.2.
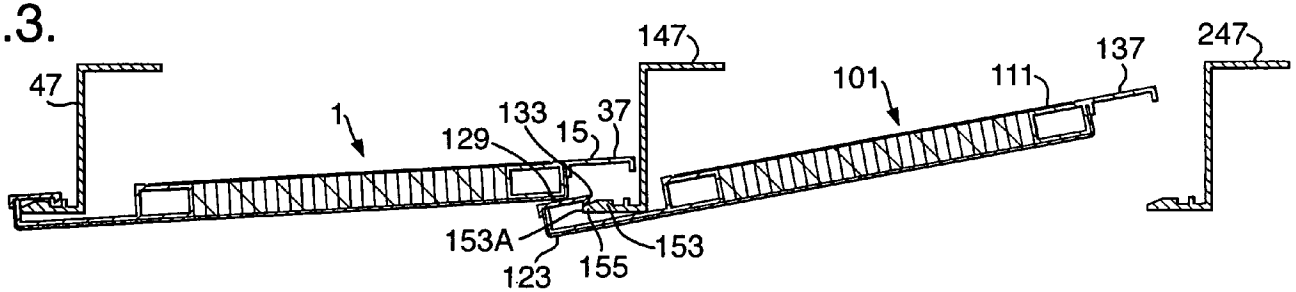
Fig.4.3.
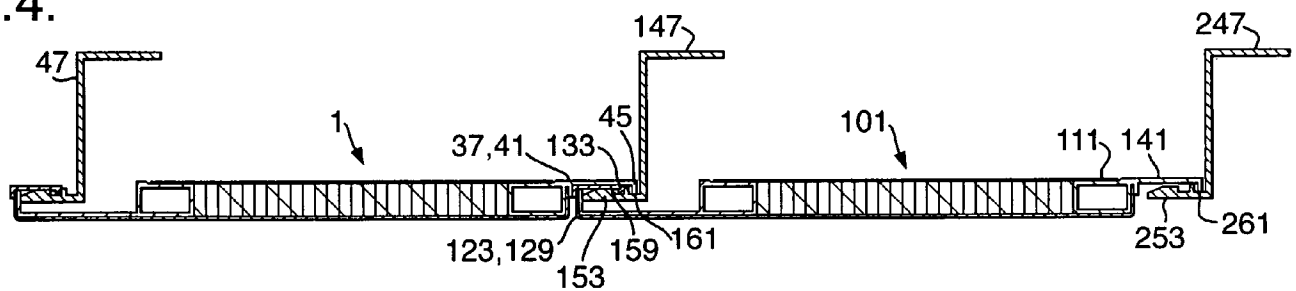
Fig.4.4.

CEILING PANELING SYSTEM

CROSS REFERENCE TO RELATED PATENT APPLICATIONS

This application is a non-provisional patent application which claims priority to European Patent Application No. 02078119.1, filed 30 Jul. 2002. The European Application No. 02078119.1 is hereby incorporated by reference as thought fully set forth herein.

BACKGROUND OF INVENTION

1. Field of Invention

This invention relates to a paneling system for ceilings of a building in which panels are suspended by hook-shaped flanges, on opposite sides of each panel, from flat arms of L- or Z-shaped panel carriers or support rails. This invention particularly relates to ceiling panels with hook-shaped flanges, one flange of each panel extending over the flange of the neighboring panel atop the horizontal arm of a panel carrier.

2. Description of Known Art

Such paneling systems are described in DE 1 934 185, FR 1 203 394, and DE 84 37 592 U. For example, DE 1 934 185 describes: a plurality of conventional, horizontal spaced apart, parallel, panel carriers (1), each having a horizontal arm with an upstanding free end (2), so that the arm forms an upwardly-open U-shaped channel; and a plurality of adjacent, horizontally-extending, ceiling panels (3), each panel having a hook-shaped flange (4, 5) on each horizontally opposite side, forming a downwardly-open U-shaped channel above the bottom of the panel. One hook-shaped flange (5) of each panel (3) has a horizontally narrow, inwardly-extending top portion (7) and, at its free end, an inwardly- and downwardly-extending rim or edge (8), and the other hook-shaped flange (4) has a horizontally longer, outwardly-extending top portion (6) and, at its free end, a downwardly- and inwardly-extending rim (9, 10). The narrow flange (5) is provided under the longer flange (4) when adjacent panels (3) are installed with their flanges overlying the arm of a carrier, between the adjacent panels, and overlying the upstanding free end (2) of that carrier's arms.

SUMMARY OF INVENTION

In accordance with this invention, a ceiling paneling system, is provided with panels having improved hook-shaped flanges on opposite sides of the panels and panel carriers with improved arms adapted to hold the panels' flanges, so as to enable easy installation and removal of individual panels. The paneling system comprises:

a plurality of adjacent, longitudinally-extending panels: each panel having a pair of hook-like flanges on longitudinally-opposite sides; each hook-like flange forming a downwardly-open U-shaped channel above the bottom of the panel; a first hook-like flange of each panel having an inwardly-extending first top portion and, at its free end, a downwardly-extending first rim; a second hook-like flange of each panel having an outwardly-extending second top portion and, at its free end, a downwardly-extending second rim; the second top portion being of substantially the same length, but slightly longer, than the first top portion; and the first rim being longitudinally spaced away from an adjacent side of the panel; and a plurality of longitudinally spaced apart, parallel panel carriers, each carrier having a longitudinally-extending arm with an upstanding free end forming an upwardly-open U-shaped channel; both the first top portion of a first flange on one longitudinal side of a first panel and the second top portion of a first flange on one longitudinal side of a first panel and the second top portion of a second flange on the opposite longitudinal side of an adjacent second panel being atop the arm of the carrier to attach the first and second panels to the carrier; the second top portion being atop the first top portion.

Preferably, the first rim on the first flange of each panel comprises a downwardly-extending locking member with a downwardly and outwardly angled surface facing the adjacent side of the panel. It is also preferred that an arm of each carrier comprises an upwardly-extending locking lug that is longitudinally spaced away from the upstanding free end of the arm; the rims of the first and second panel, attached to the carrier, being on longitudinally opposite sides of the locking lug and preferably contact the upper surface of the arm.

BRIEF DESCRIPTION OF THE DRAWINGS

Further aspects of the invention will be apparent from the detailed description below of a particular embodiment and the drawings thereof, in which:

FIGS. 4.1-4.4 are schematic representations of how the paneling system of FIG. 3 can be assembled.

DESCRIPTION OF THE PREFERRED EMBODIMENT

Figure 1:
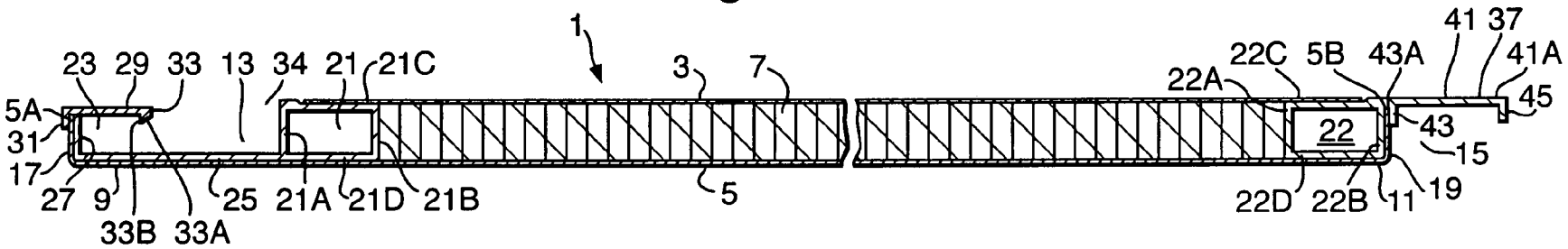
FIG. 1 is a vertical cross-section of a ceiling panel of a paneling system according to the invention.

FIG. 1 shows a conventional, longitudinally-extending, preferably rectangular ceiling panel 1 for an interior ceiling of a building. A plurality of such panels 1 can be lain side-by-side to cover a ceiling with the paneling system of this invention. The panel 1 is a metal skin sandwich panel with the top metal skin layer 3, a bottom metal skin layer 5 and a core layer 7 extending between the top and bottom skins. The bottom skin 5 is visible when the panel 1 is mounted in a ceiling. The core 7 is preferably a honeycomb material but can be any other core material or even several stacked layers of different core materials. The panel 1 can be an acoustic panel, where the bottom skin 5 is perforated. The panel 1 is preferably rectangular and has a front side (not shown), a back side (not shown), a left side 9 and a right side 11.

Longitudinally opposite sides 9, 11 of the panel 1 are adapted for attaching the panel to one of the panel carriers (shown in FIG. 2) of the paneling system of this invention. In this regard, left and right mounting profiles 13, 15 are provided on the panel, preferably by adhesively attaching them respectively to the left and right sides of the core 7. In this regard, the left mounting profile 13 includes a left profile connector 21, with a hollow rectangular cross-section, on the left side 9 of the core 7, and the right mounting 15 includes a right profile connector 22, with a hollow rectangular cross-section, on the right side 11 of the core. In order to facilitate the attachment of the profile connectors 21, 22 to the panel sides 9, 11, portions of the core 7 are removed from these sides to make room for the profile connectors which then take the place of the removed core portions. The mounting profiles 13, 15, particularly their profile connectors 21, 22, preferably have a lateral length (not shown) and the height that are the same as the panel 1. It is also preferred that the bottom skin 5 extends further longitudinally than does the top skin 3 on both sides 9, 11, so that the bottom skin 5 can be adhesively attached to, and cover, the bottom and upstanding sides of the mounting profiles 13, 15. In this way, the bottom of the panel 1, that is visible when the panel is mounted, is always covered with the bottom skin 5, and the core 7 does not show. It is also preferred that the top of the left and right profile connectors 21, 22 is also at least partially covered by the top skin 3 and that the top of the core 7 is completely covered by the top skin.

Figure 3:
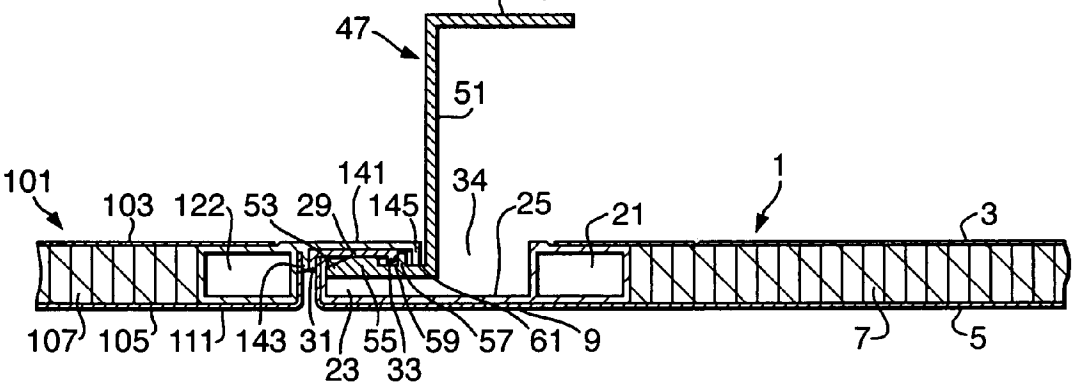
FIG. 3 is a vertical cross-section of an assembled paneling system of the invention.
Figure 3:
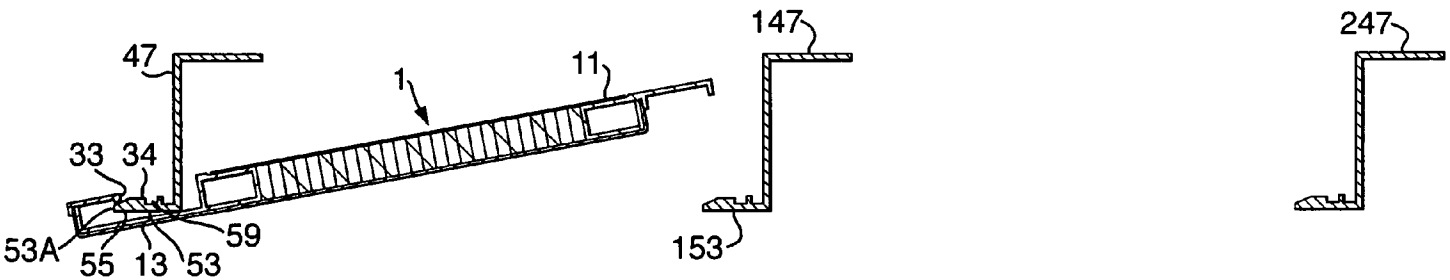

As seen from FIGS. 1 and 3, the left mounting profile 13 also includes a first or left, hook-like flange 23 forming a downwardly-open U-shaped channel above a longitudinally-extending support member 25 of the left profile 13. The support member 25 connect the left profile connector 21 with the left flange 23. In this regard, the left profile connector 21 preferably includes a left wall 21A, a right wall 21B, a top wall 21C and a bottom wall 21D, and the support member 25 is preferably integral with the bottom wall 21D.

As also seen in FIGS. 1 and 3, the left flange 23 has; an upstanding left side wall 27, the left side of which is preferably covered by the bottom skin 5; and a left top wall 29 that is atop the upstanding left wall and extends to the right, horizontally and inwardly (i.e., towards the adjacent panel side 9), away from the left side wall 27. Preferably, the left top wall 29 also extends to the left, horizontally and outwardly (i.e., away from the adjacent panel side 9), away from the left side wall 27 and over the width of the left side wall and an upstanding left end of the bottom skin 5. A small downwardly-extending left outer rim 31 on the left end of the left top wall 29 holds securely the left end of the bottom skin 5 against the left side wall. At the right end of the left top wall 29 is a small downwardly-extending left inner rim 33 for locking the panel to a carrier. The left inner rim 33 has an inner surface 33A, facing the adjacent side 9 of the panel, and an outer surface 33B. The inner surface 33A is preferably slanted downwardly and leftwardly (i.e., outwardly of the core 7). The left inner rim 33 is longitudinally spaced away from the adjacent left wall 21A of the left profile connector 21 on the left side 9 of the panel to form a horizontal gap 34 in the left mounting profile 13 over the support member 25.

As further seen from FIG. 1, the right mounting profile 15 also includes a second or right, hook-like flange 37 forming a downwardly-open U-shaped channel. The right, hook-like flange 37 is connected to the right side of the right profile connector 22. In this regard, the right profile connector 22 preferably includes a left wall 22A, a right wall 22B which is preferably covered by the bottom skin 5, a top wall 22C which is integral with the right flange 37, and a bottom wall 22D.

As still further seen in FIG. 1, the right flange 37 has a right top wall 41 that extends to the right, horizontally and outwardly (i.e., away from the adjacent panel side 11), away from the top wall 22C of the right profile connector 22, and a depending left rim 43 that is adjacent the right wall 22B of the right profile connector 22 and that holds securely the right end of the bottom skin 5 against the right wall 22B. At the right end of the right top wall 41 is a small downwardly-extending right rim 45 for locking the panel to a panel carrier. Preferably, the right top wall 41 is not covered by the top skin 3.

In accordance with this invention, the right top wall 41 of the right flange 37 extends to the right, horizontally and outwardly, away from the top wall 22C of the right profile connector 22 by a distance that is the substantially the same, but slightly greater, than the distance that the left top wall 29 of the left flange 23 extends to the right, horizontally and inwardly, away from the left side wall 27. Thereby, the right top wall 41 can completely cover left top wall 29 when the right top wall lies directly atop the left top wall when the flanges 23, 37 are used to mount a pair of panels 1 on a carrier.

Also in accordance with this invention, the right rim 45 of the right flange 37 extends downwardly from its right top wall 41 by a distance that is substantially the same, but slightly greater, than the distance that the left inner rim 33 of the left flange 23 extends downwardly from the right side of its left top wall 29. Thereby, when the right top wall 41 lies directly atop the left top wall 29, the bottom of the right rim 45 will be substantially horizontal with the bottom of the left inner rim 33.

The mounting profiles 13, 15 are preferably made as extrusions that are mounted on the left and right sides 9, 11 of the panel 1, adjacent its core 7. However, the mounting profiles 13, 15 could also be integrally formed with the bottom skin 5 of the panel or with the core 7.

Figure 2:
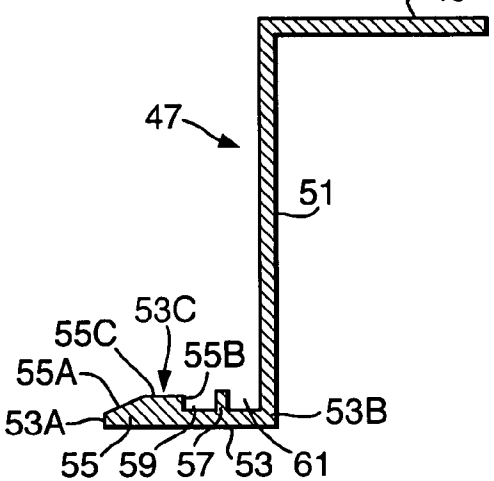
FIG. 2 is a vertical cross-section of a panel carrier of a paneling system according to the invention.

FIGS. 2 and 3 show a preferred panel carrier 47 of the paneling system of this invention. A plurality of such carriers 47, in parallel and spaced apart relationship, can be used to support a plurality of the panels 1 of FIG. 1 to cover a ceiling with the paneling system of this invention. Depending on the type of ceiling or wall construction to be used with the panel 1, the carrier 47 can be an elongated extrusion or a hook-like member.

As shown in FIGS. 2 and 3, the carrier 47 preferably has a conventional, generally L- or Z-shaped configuration, with; a horizontally-extending top flange 49, to be connected to a ceiling or panel suspension system; a vertically-extending intermediate member 51, the top of which is connected to the left end of the top flange; and a horizontally-extending bottom flange 53, connected to the bottom of the intermediate member. The bottom flange 53 preferably extends horizontally and leftwardly away from the top flange 49 to a free left side 53A. The top surface 53C of the bottom flange 53, on which a pair of panels 1 can be mounted, has: a vertically-extending locking lug 57, between a carrier lug 55 and the intermediate member 51. The carrier lug 55 has: a gentle left ramp 55A extending downwardly and leftwardly towards the free left side 53A of the bottom flange 53; a sharper, vertically downward or angled-back right wall 55B; and a top wall 55C, between them. The left ramp 55A facilitates the installation of a panel 1 on the carrier 47, even when the adjacent panel 1 is already in place as will be explained below. The height of the top wall 55C of the carrier lug, above the top surface 53C of the bottom flange 53, is at least equal to the distance that the left inner rim 33 extends below the left top wall 29 of the left flange 23, and the locking lug 57 preferably has a height above the top surface of the bottom flange that is at least equal to the distance that the right rim 45 extends below the right top wall 41 of the right flange 37. Hence, the locking lug 57 is preferably higher than the carrier lug 55, and this difference in height should be at least equal to the difference in the height of the right rim 45 and the left inner rim 33.

Between the carrier lug 55 and the locking lug 57, there is a first or left, upwardly-open U-shaped carrier channel 59, adapted to receive the left inner rim 33 of the left flange 23 when a panel 1 is mounted on the panel carrier 47. Between the carrier locking rim 57 and the upstanding intermediate member 51 is a second or right, upwardly-open U-shaped carrier channel 61, adapted to receive the right rim 45 of the second flange 37 when a panel 1 is mounted on the panel carrier 47.

FIG. 3 shows a carrier with a pair of adjacent ceiling panels of FIG. 1, mounted on the panel carrier of FIG. 2. The panels are the same, but for clarity, like parts of one panel have the same reference numerals as the panel of FIG. 1 while the other panel has reference numerals greater by "100" than those of the panel of FIG. 1.

As shown in FIG. 3, the left top wall 29 of the left flange 23 of the left mounting profile 13 of one of the panels 1 is mounted on the carrier lug 55 of the bottom flange 53 of the panel carrier 47. This was done by tilting the panel upwardly to the right and moving its left side 9, so as to: i) insert the free end 53A of the bottom flange 53 of the carrier 47 through the vertical gap 34 in the left mounting profile 13 of the panel, between the left inner rim 33 and the left profile connector 21; and ii) then hook the left flange 23 over the carrier lug 55, so that the left inner rim 33 passes over the carrier lug 55 and past its right wall 55B. As a result, the bottom of the left inner rim rests on the top surface 53C of the bottom flange 53 in the left carrier channel 59.

On top of the left top wall 29 of the left flange 23 in FIG. 3 is the right top wall 141 of the right flange 137 of the right mounting profile 115 of the other panel 101. The bottom surface of its right top wall 141 rests on the top surface of the left top wall 29 of the left flange 23 of the panel 1. The left outer rim 31 of the left flange 23 of the panel 1 abuts the depending left rim 143 of the right flange 137 of the adjacent panel 101. The bottom of the right rim 145 of the right flange 137 rests on the top surface 53C of the bottom flange 53 of the carrier 47 in the second carrier channel 61.

FIG. 3 clearly shows that the height of the left top wall 29 (i.e., the height of the upstanding left side wall 27) of the left flange 23, above the support member 25, is substantially more than the height of the carrier lug 55 to assure maneuvering height when installing the left side 9 of the panel 1, before the right side 111 of the other panel 101, on the bottom flange 53 of the carrier 47. Also, the gap 34 in the left mounting profile 13 of the panel 1 is sufficiently wide horizontally, so that the left side 9 of the panel can be moved around the flange 53 of the carrier 47 to insert the flange's free end 53A between the left top wall 29 and the support member 25 of the left mounting profile. Further, the slopes of the left ramp 55A of the carrier lug 55 and the inner surface 33A of the left inner rim 33 preferably allow the left inner rim 33 to ride easily upward along the left ramp 55A when installing the left flange 23 of a panel 1 on the carrier 47. In addition, the locking lug 57 of the carrier 47, which provides a wall between both the left and right, carrier channels 59 and 61, is preferably a bit higher than the carrier lug 55. In this regard, the excess height of the locking lug 57 is preferably a little less or equal to the thickness of the right top wall 141 of the right flange 137, thus ensuring that the right top wall contacts the whole horizontal length of the left top wall 29 when the right and left flanges are atop one another on the carrier's bottom flange 53.

FIGS. 4.1-4.4 show a methods of mounting and dismounting a plurality of identical ceiling panels 1, 101, 201, etc. of FIG. 1 and on a plurality of parallel identical carriers 47, 147, etc. of FIGS. 2 and 3, mounted on a ceiling.

Step 1. As shown in FIG. 4.1, a first panel 1 is mounted on parallel adjacent, first and second carriers 47, 147. The first panel is first slightly tilted with its right side 11 extending upward, so that the first panel can then be placed between the two carriers. The bottom flange 53 of the first carrier 47 is then inserted through the vertical gap 34 in the left mounting profile 13 of the first panel. Then, the left flange 23 of the left mounting profile 13 of the first panel is hooked around the free end 53A of the bottom flange of the first carrier, so that its left inner rim 33 is over the carrier lug 55 while the right side 11 of the panel is above the bottom flange 153 of the second carrier 147. While hooking the first panel 1 over the carrier's free end 53A, the left inner rim 33 rides upwardly and leftwardly along the left ramp 55A of the carrier lug 55 to a position where the left inner rim 33 can subsequently descend into the left carrier channel 59 on the bottom flange 53 when the right side 11 of the first panel is moved downwardly until the first panel is horizontal.

Step 2. As shown in FIG. 4.2, the right side 11 of the panel 1 is subsequently lowered, and the right rim 45 of the right flange 37 rests in the right carrier channel 161 on the bottom flange 153 of the second carrier 147.

Step 3. As shown in FIG. 4.3, a second panel 101 is subsequently mounted on the second carrier 147 and on a third carrier 247 by first lifting slightly the right flange 37 of the first panel from the bottom flange 153 of the second carrier 147 as shown in FIG. 4.3. Then, the second panel 101 is slightly tilted with its right side 111 extending upward, so that the second panel can then be inserted between the two carriers 147, 247. The left flange 123 of the second panel 101 is then hooked around the second carrier's free end 153A as described above in Step 1. In so hooking the left flange 123, its left inner rim 133 and its left top wall 129 pass between the carrier lug 155 of the second carrier 147 and the right mounting profile 15 of the first panel 1.

Step 4. As shown in FIG. 4.4, the right side 111 of the second panel 101 is subsequently lowered, so that the right rim 145 of its right flange 137 rests in the right carrier channel 261 of the bottom flange 253 of the third carrier 247 and the left inner rim 133 of its left flange 123 rests in the left carrier channel 159 of the bottom flange 153 of the second carrier 147. Then, the right side 11 of the first panel 1 is lowered, so that the right top wall 41 of its right flange 37 rests atop the left top wall 129 of the left flange 123 of the second panel 101 and the right rim 45 of its right flange 37 rests in the right carrier channel 161 of the bottom flange 153 of the second carrier 147.

Of course, these mounting steps can be repeated for more panels and panel carriers. These steps can also be reversed for easily dismounting any panels from the carriers, to which they are attached.

This invention is, of course, not limited to the above-described embodiments which may be modified without departing from the scope of the invention or sacrificing all of its advantages. In this regard, the terms in the foregoing description and the following claims, such as "right," "left," "front," "back," "vertically," "horizontally," "longitudinally," "upper," "lower," "top," and "bottom," have been used only as relative terms to describe the relationships of the various elements of the panel and carrier of the ceiling paneling system of this invention.

For example, the left and right mounting profiles 13, 15 of panel 1 are preferably each made as one piece, but can also be made as separate pieces with separate profiles connectors 19, 21, elongated supporting member 25 and hook-like flanges 23, 37, which are subsequently attached. Moreover, the paneling system of this invention is also applicable to the walls of buildings and is not limited to their ceilings.

The invention claimed is:

1. The combination of a carrier and a panelling system wherein said panelling system has at least a pair of longitudinally adjacent panels, each of which has a first and second hook-shaped flange extending longitudinally from longitudinally opposite sides of the panel, the carrier comprising:

an arm that extends longitudinally from a vertically-extending member, said arm including: i) a first upwardly-open U-shaped channel between an upstanding free end and an upstanding locking lug and ii) a second upwardly-open U-shaped channel between the locking lug and the vertically-extending member;

wherein the first channel of said carrier receives therein the first hook-shaped flange of one panel of the pair of panels and the second channel of the carrier receives therein the second flange of the other panel of the pair of panels to attach the pair of panels to the carrier; and further, wherein first and second flanges extend longitudinally over the upstanding free end of the carrier.

2. The combination of claim 1 wherein the upstanding free end of the arm comprises a downwardly and outwardly angled surface along which the first hook-shaped flange of one panel of the pair of panels slides during installation of the panels onto the carrier.

3. The combination of claim 1 or claim 2 wherein the locking lug extends vertically higher than the upstanding free end.

4. The combination of claim 1 wherein the first hook-shaped flange comprises a first downwardly-extending rim with a downwardly and outwardly angled surface facing the adjacent longitudinal side of the panel; the rim slidably receiving the upstanding free end of one of the carrier during installation of the panel to the carrier.

* * * * *